US009274447B2

(12) United States Patent
Sawai et al.

(10) Patent No.: US 9,274,447 B2
(45) Date of Patent: Mar. 1, 2016

(54) TWO-COMPONENT COLOR DEVELOPER AND IMAGE FORMATION DEVICE USING SAME

(75) Inventors: Tadayuki Sawai, Osaka (JP); Yoritaka Tsubaki, Osaka (JP); Keiichi Kikawa, Osaka (JP); Keigo Mitamura, Osaka (JP); Yui Kawano, Osaka (JP); Shintaro Fukuoka, Osaka (JP)

(73) Assignee: SHARP KABUSHIKI KAISHA, Osaka-Shi (JP)

( * ) Notice: Subject to any disclaimer, the term of this patent is extended or adjusted under 35 U.S.C. 154(b) by 48 days.

(21) Appl. No.: 14/346,713

(22) PCT Filed: Jul. 25, 2012

(86) PCT No.: PCT/JP2012/068860
§ 371 (c)(1),
(2), (4) Date: Mar. 21, 2014

(87) PCT Pub. No.: WO2013/042453
PCT Pub. Date: Mar. 28, 2013

(65) Prior Publication Data

US 2014/0242510 A1 Aug. 28, 2014

(30) Foreign Application Priority Data

Sep. 22, 2011 (JP) ..... 2011-207676

(51) Int. Cl.
*G03G 9/08* (2006.01)
*G03G 9/113* (2006.01)
(Continued)

(52) U.S. Cl.
CPC ..... *G03G 9/1133* (2013.01); *G03G 9/08755* (2013.01); *G03G 9/08795* (2013.01); *G03G 9/08797* (2013.01); *G03G 9/0906* (2013.01); *G03G 9/09708* (2013.01);
(Continued)

(58) Field of Classification Search
CPC ..... G03G 9/08755; G03G 9/08797
USPC ..... 430/109.4, 111.4
See application file for complete search history.

(56) References Cited

U.S. PATENT DOCUMENTS

| | | | |
|---|---|---|---|
| 8,481,239 | B2 | 7/2013 | Nakajima et al. |
| 8,586,276 | B2 | 11/2013 | Matsumoto et al. |
| 2009/0202935 | A1 | 8/2009 | Moriya et al. |

FOREIGN PATENT DOCUMENTS

| | | | |
|---|---|---|---|
| JP | 11-272016 | A | 10/1999 |
| JP | 2000-284523 | A | 10/2000 |

(Continued)

OTHER PUBLICATIONS

"The state of the art of the electrophotographic toner", Technical Information Institute Co., Ltd., Dec. 15, 2004, pp. 244-245.

(Continued)

*Primary Examiner* — Mark A Chapman
(74) *Attorney, Agent, or Firm* — Birch, Stewart, Kolasch & Birch, LLP

(57) ABSTRACT

A two-component color developer containing a toner and a resin-coated carrier, the toner containing at least a polyester resin as a binding resin, an organic pigment as a colorant and inorganic fine particles as an external additive, wherein the inorganic fine particles have a negative polarity, the toner has a volume resistivity of $40\times10^9$ to $220\times10^9$ Ωcm and a negative polarity, and the carrier has a coat durability of 90% or greater.

4 Claims, 1 Drawing Sheet

(51) Int. Cl.

| | |
|---|---|
| ***G03G 9/087*** | (2006.01) |
| ***G03G 9/09*** | (2006.01) |
| ***G03G 9/097*** | (2006.01) |
| ***G03G 13/08*** | (2006.01) |
| *G03G 15/08* | (2006.01) |

(52) U.S. Cl.

CPC ..... *G03G 13/08* (2013.01); *G03G 15/0806* (2013.01); *G03G 2215/0607* (2013.01)

(56) References Cited

FOREIGN PATENT DOCUMENTS

| | | | |
|---|---|---|---|
| JP | 2001-260235 | A | 9/2001 |
| JP | 2003-241436 | A | 8/2003 |
| JP | 2004-45925 | A | 2/2004 |
| JP | 2005-234233 | A | 9/2005 |
| JP | 2005-316306 | A | 11/2005 |
| JP | 2006-47697 | A | 2/2006 |
| JP | 2008-90028 | A | 4/2008 |
| JP | 2009-53545 | A | 3/2009 |
| JP | 2009-192675 | A | 8/2009 |
| JP | 2010-32770 | A | 2/2010 |
| JP | 2011-145648 | A | 7/2011 |

OTHER PUBLICATIONS

International Search Report, mailed Nov. 6, 2012, issued in PCT/JP2012/068860.

The Imaging Society of Japan, 51th ISJ's Technical Course Text, Jul. 18, 2001, pp. 116, 120-121 and 124.

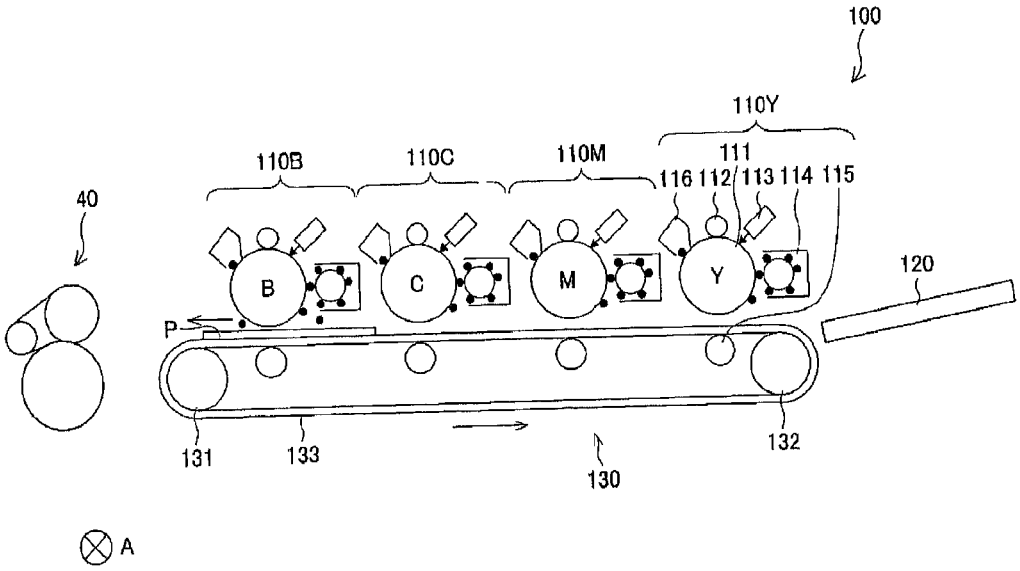
100
110Y
110B
110C
110M
111
116 112 113 114 115
40
B
C
M
Y
120
P
131
133
130
132
A

TWO-COMPONENT COLOR DEVELOPER AND IMAGE FORMATION DEVICE USING SAME

TECHNICAL FIELD

The present invention relates to a two-component color developer and an image formation device (forming apparatus) using the same.

BACKGROUND ART

With recent development of electronic devices, color imaging, high image quality and high imaging speed are required in the art of image formation by electrophotography, and there have been various developments in technology for achieving colorization, particle size reduction and ensured fixing ability in toner, and ensured stability in toner and developer against environmental variation, and so on.

For example, Japanese Unexamined Patent Publication No. HEI 11 (1999)-272016 (Patent Document 1) discloses an electrophotographic toner mainly containing a binding resin, a colorant, an azo metal compound and a triphenylmethane compound, and having a volume resistivity of $3\times10^{10}$ to $15\times10^{10}$ Ωcm, wherein the content ratio by weight of the azo metal compound to the triphenylmethane compound is 3:97 to 97:3.

Thereby, an electrophotographic toner which can be applied to copying machines and the like including whichever of positively and negatively charged photoreceptors and which maintains stable tribocharge properties over a long period of time is provided, and a sufficient image density and stable image properties with less background fogging are achieved.

In addition, Japanese Unexamined Patent Publication No. 2005-316306 (Patent Document 2) discloses an electrophotographic two-component developer including toner particles containing a binding resin, a colorant and a charge controlling agent; and a silicon resin-coated ferrite-based carrier, wherein the colorant content is 10% by weight or more with respect to the total amount of the toner particles, the toner particles have a specific volume resistance of $20\times10^{9}$ to $85\times10^{9}$ Ωcm, and the ferrite-based carrier has a resistance of $2.0\times10^{10}$ to $1.0\times10^{12}$ Ωcm when a 500-V DC electric field is applied by a bridge method at a distance of 6.5 mm.

Thereby, an electrophotographic two-component developer is provided which allows toner therein to be given a sufficient amount of charge so that high-quality images can be steadily formed even in image formation under a high-temperature and high-humidity environment, image formation from a document having a so high coverage that the image density exceeds 35%, or the like.

RELATED ART DOCUMENTS

Patent Documents

Patent Document 1: Japanese Unexamined Patent Publication No. HEI 11 (1999)-272016

Patent Document 2: Japanese Unexamined Patent Publication No. 2005-316306

SUMMARY OF THE INVENTION

Problems to be Solved by the Invention

However, the techniques of Patent Documents 1 and 2 do not take into consideration the coat durability of carriers for ensuring the stability of the developers against environmental variation.

A problem to be solved by the present invention is to provide a two-component color developer which is stable against environmental variation and which can prevent toner scattering and generation of white spots, and to provide an image forming apparatus in which the developer is used.

Means for Solving the Problems

The inventors of the present invention have made intensive studies to solve the above-described problem and, as a result, found that a two-component color developer can be obtained which is stable against environmental variation, and capable of preventing toner scattering and white spots, as long as it is a two-component color developer containing a toner and a resin-coated carrier, the toner containing at least a polyester resin as a binding resin, an organic pigment as a colorant and inorganic fine particles as an external additive, wherein the inorganic fine particles have a negative polarity, the toner has a specific volume resistivity and a negative polarity, and the carrier has a specific coat durability. Thus, the inventors have reached completion of the present invention.

The present invention therefore provides a two-component color developer containing a toner and a resin-coated carrier, the toner containing at least a polyester resin as a binding resin, an organic pigment as a colorant and inorganic fine particles as an external additive, wherein the inorganic fine particles have a negative polarity, the toner has a volume resistivity of $40\times10^{9}$ to $220\times10^{9}$ Ωcm and a negative polarity, and the carrier has a coat durability of 90% or greater.

The present invention also provides an image forming apparatus in which the above-described two-component color developer is used.

Effects of the Invention

The present invention can provide a two-component color developer which is stable against environmental variation and which can prevent toner scattering and generation of white spots, and an image forming apparatus in which the developer is used.

The effect of the present invention is more significant when the organic pigment is a magenta pigment or a yellow pigment, and when the polyester resin has a volume resistivity of $250\times10^{9}$ to $400\times10^{9}$ Ωcm, and when the binding resin has a weight average molecular weight in the range from 9,000 to 90,000, and molecular weights of 100,000 or more account for 10 to 30% in the molecular weight distribution of the binding resin.

BRIEF DESCRIPTION OF THE DRAWINGS

FIG. 1 is a schematic cross sectional view illustrating an example of an image forming apparatus of the present invention.

MODE FOR CARRYING OUT THE INVENTION

A two-component color developer of the present invention is characterized by containing a toner and a resin-coated carrier, the toner containing at least a polyester resin as a binding resin, an organic pigment as a colorant and inorganic fine particles as an external additive, wherein the inorganic fine particles have a negative polarity, the toner has a volume resistivity of $40\times10^{9}$ to $220\times10^{9}$ Ωcm and a negative polarity, and the carrier has a coat durability of 90% or greater.

The two-component color developer of the present invention is obtained by mixing a toner and a carrier that have the above-described physical properties by a commonly known method.

Hereinafter, each component will be described.

(1) Toner

The toner of the present invention contains at least a polyester resin as a binding resin, an organic pigment as a colorant and inorganic fine particles as an external additive, and may contain commonly known additives such as a charge controlling agent and a release agent, for example, as needed to the extent that the effect of the present invention is not lessened.

(Binding Resin: Also Referred to as Binder Resin)

The polyester resin as the binding resin of the toner of the present invention is usually obtained by a condensation polymerization reaction, esterification or transesterification of one or more kinds selected from dihydric alcohol components and trihydric or higher alcohol components with one or more kinds selected from divalent carboxylic acids and trivalent or higher carboxylic acids according to a commonly known method.

Conditions for the condensation polymerization reaction may be determined as appropriate according to the reactivity of the monomer components, and the reaction may be stopped when the polymer has acquired suitable physical properties. For example, the reaction temperature is approximately 170 to 250° C., and the reaction pressure is approximately 5 mmHg to normal pressure.

Examples of the dihydric alcohol components include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)prop ane and polyoxypropylene(6)-2,2-bis(4-hydroxyphenyl)propane; diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol and polytetramethylene glycol; bisphenol A; propylene adducts of bispenol A; ethylene adducts of bisphenol A; and hydrogenated bisphenol A.

Examples of the trihydric or higher alcohol components include sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

In the present invention, one kind of the above-mentioned dihydric alcohol components and the trihydric or higher alcohol components may be used independently, or two or more kinds thereof may be used in combination.

Examples of the divalent carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebatic acid, azelaic acid, malonic acid, n-dodecenylsuccinic acid, n-dodecylsuccinic acid, n-octylsuccinic acid, isooctenylsuccinic acid and isooctylsuccinic acid, and anhydrides or lower alkyl esters of these acids.

Examples of the trivalent or higher carboxylic acids include 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid and empole trimer acid, and anhydrides or lower alkyl esters of these acids.

In the present invention, one kind of the above-mentioned divalent carboxylic acids and the trivalent or higher carboxylic acids may be used independently, or two or more kinds thereof may be used in combination.

In the present invention, preferably, the binding resin has a weight average molecular weight in the range from 9,000 to 90,000 (more preferably, from 20,000 to 70,000), and molecular weights of 100,000 or more account for 10 to 30% (more preferably, 10 to 20%) in the molecular weight distribution thereof.

With the weight average molecular weight in the above-specified range, the effect of the present invention is more significant. When the weight average molecular weight is less than 9,000, the release properties on a high-temperature side in fixing may be poor. When the weight average molecular weight is more than 90,000, the low-temperature fixability may be poor.

Specific examples of the weight average molecular weight include 9,000, 10,000, 15,000, 20,000, 25,000, 30,000, 35,000, 40,000, 45,000, 50,000, 55,000, 60,000, 65,000, 70,000, 75,000, 80,000, 85,000 and 90,000.

When molecular weights of 100,000 or more account for the above-specified percentage in the molecular weight distribution, the effect of the present invention is more significant. When molecular weights of 100,000 or more account for less than 10%, the release properties on a high-temperature side in fixing may be poor. When molecular weights of 100,000 or more account for more than 30%, the low-temperature fixability may be poor.

Specific examples of the percentage that molecular weights of 100,000 account for include 10%, 12.5%, 15%, 17.5%, 20%, 22.5%, 25%, 27.5% and 30%.

(Colorant)

As the organic pigment as the colorant of the toner of the present invention, various kinds and colors of organic pigments that are conventionally used in the art may be used. Examples thereof include yellow, orange, red, violet, blue and green pigments.

Examples of the yellow pigments include Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94 and C.I. Pigment Yellow 138.

Examples of the orange pigments include Permanent Orange GTR, Pyrazolone Orange, Vulcan Orange, Indanthrene Brilliant Orange RK, Benzidine Orange G, Indanthrene Brilliant Orange GK, C. I. Pigment Orange 31 and C. I. Pigment Orange 43.

Examples of the red pigments include Permanent Red 4R, Lithol Red, Pyrazolone Red, Watching Red, Lake Red C, Lake Red D, Brilliant Carmine 6B, Eosine Lake, Rhodamine Lake B, Alizalin Lake, Brilliant Carmine 3B, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Examples of the purple pigments include Fast Violet B and Methyl Violet Lake.

Examples of the blue pigments include Alkali Blue Lake, Victoria Blue Lake, Phthalocyanine Blue, Metal-free Phthalocyanine Blue, partially chlorinated Phthalocyanine Blue, Fast Sky Blue, Indanthrene Blue BC, C. I. Pigment Blue 15, C. I. Pigment Blue 15:2, C. I. Pigment Blue 15:3, C. I. Pigment Blue 16 and C. I. Pigment Blue 60.

Examples of the green pigments include Pigment Green B, Malachite Green Lake, Final Yellow Green G and C. I. Pigment Green 7.

In the present invention, one kind of the above-mentioned colorants may be used independently or two kinds thereof may be used in combination, and colorants of the same color or of different colors may be combined.

Alternatively, two or more kinds of the colorants may be used in the form of composite particles.

The composite particles can be prepared by, for example, adding appropriate amounts of water, a lower alcohol and the like to two or more kinds of the colorants, granulating the mixture with a common granulating machine such as a high-speed mil, and drying the granules.

Furthermore, the colorants may be used in the form of a masterbatch in order to uniformly disperse the colorants in the binding resin.

The composite particles and the masterbatch are mixed with a toner composition in dry blending.

The amount of the colorant to blend is not particularly limited and is preferably 0.1 to 20 parts by weight and particularly preferably 0.2 to 10 parts by weight with respect to 100 parts by weight of the binding resin.

When the amount of the colorant to blend is within the above-specified range, it is possible to form images that are high-density and very high-quality without impairing the physical properties of the toner.

Specific examples of the amount of the colorant to blend include 0.1, 0.2, 0.5, 1, 2.5, 5, 7.5, 10, 12.5, 15, 17.5 and 20 parts by weight with respect to 100 parts by weight of the binding resin.

(Charge Controlling Agent)

As the charge controlling agent that may be added to the toner of the present invention, charge controlling agents conventionally used in the art may be used, and charge controlling agents for negative charge control capable of giving a negative polarity to the toner are preferable.

Examples of the charge controlling agents for negative charge control include oil-soluble dyes such as oil black and spilon black, metal-containing azo compounds, azo complex dyes, naphthenic soap, metallic complexes and metallic salts of salicylic acid and derivatives thereof (metal: chromium, zinc, zirconium and the like), boron compounds, fatty acid soap, long-chain alkyl carboxylates, and resin acid soap.

In the present invention, one kind of the above-mentioned charge controlling agents may be used independently, or two or more kinds thereof may be used in combination.

The amount of the charge controlling agent to blend is not particularly limited and is preferably 0.5 to 3 parts by weight and particularly preferably 1 to 2 parts by weight with respect to 100 parts by weight of the binding resin.

When the amount of the charge controlling agent to blend is within the above-specified range, it is possible to form images that are high-density and very high-quality without impairing the physical properties of the toner.

Specific examples of the amount of the charge controlling agent to blend include 0.5, 0.75, 1, 1.25, 1.5, 2, 2.25, 2.5 and 3 parts by weight with respect to 100 parts by weight of the binding resin.

(Release Agent)

As the release agent that may be added to the toner of the present invention, release agents that are conventionally used in the art may be used.

Examples of the release agent include petroleum-based waxes such as paraffin waxes and microcrystalline waxes, and derivatives thereof; hydrocarbon-based synthetic waxes such as Fischer-Tropsch waxes, polyolefin waxes (polyethylene waxes, polypropylene waxes), low molecular weight polypropylene waxes and polyolefin-based polymeric waxes (low molecular weight polyethylene waxes), and derivatives thereof; plant-based waxes such as carnauba wax, rice wax and candelilla wax, and derivatives thereof, and Japan wax; animal-based waxes such as bees wax and spermaceti wax; oil and fat-based synthetic waxes such as fatty amides and phenol fatty acid esters; long-chain carboxylic acids and derivatives thereof; long-chain alcohols and derivatives thereof; silicone-based polymers; and high fatty acids.

The derivatives include oxides, block copolymers of the waxes with vinylic monomers and graft modified products of the waxes with vinylic monomers.

In the present invention, one kind of the above-mentioned release agents may be used independently, or two or more kinds thereof may be used in combination.

Preferably, the release agent is a hydrocarbon release agent having a melting point of 70° C. or lower. The lower limit thereof is approximately 60° C. When the melting point is 70° C. or lower, the effect of the present invention is more significant, and it is preferable particularly for the low-temperature fixability.

Specific examples of the melting point of the release agent include 70° C., 69° C., 68° C., 67° C., 66° C., 65° C., 64° C., 63° C., 62° C., 61° C. and 60° C.

The amount of the release agent to blend is not particularly limited and is preferably 0.2 to 20 parts by weight, more preferably 0.5 to 10 parts by weight and particularly preferably 1.0 to 8.0 parts by weight with respect to 100 parts by weight of the binding resin.

When the amount of the release agent to blend is within the above-specified range, it is possible to form images that are high-density and very high-quality without impairing the physical properties of the toner.

Specific examples of the amount of the release agent to blend include 0.2, 0.5, 1, 2.5, 5, 7.5, 8, 10, 12.5, 15, 17.5 and 20 parts by weight with respect to 100 parts by weight of the binding resin.

(External Additive)

As an external additive of the toner of the present invention, the inorganic fine particles are used to improve the transportability and the chargeability of the toner, and the miscibility with the carrier when the toner is in the form of a two-component developer.

As the external additive, any external additives that are conventionally used in the art may be used. Examples thereof include inorganic fine particles such as silica and titanium oxide, and those given a surface treatment (hydrophobizing treatment) with hexamethyldisilazane (HMDS), silicone resin, silane coupling agent, or the like are preferable.

The volumetric average particle diameter of the inorganic fine particles is not particularly limited and may be approximately 5 to 300 nm, which is equal to the volumetric average particle diameter of external additives that are used in the art.

Two or more kinds of inorganic fine particles having different particle diameters may be used.

The amount of the external additive to blend is preferably 1 to 10 parts by weight and more preferably 2 to 5 parts by weight with respect to 100 parts by weight of the toner.

Specific examples of the amount of the external additive to blend include 1, 2, 3, 4, 5, 6, 7, 8, 9 and 10 parts by weight with respect to 100 parts by weight of the toner.

Preferably, the inorganic fine particles have a negative polarity. When the inorganic fine particles have a positive polarity, there will be so many toner particles having zero to positive charge in the charge amount distribution of the toner that toner scattering and background fogging are likely to occur.

(Method for Producing Toner)

The toner of the present invention is obtained by preparing toner particles by a common toner particle preparation method, for example, such commonly known methods as dry processes including a pulverizing method; and wet processes including a suspension polymerization method, an emulsion aggregation method, a dispersion polymerization method, a melting suspension method and a melting emulsion method, and externally adding and mixing the inorganic fine particles as the external additive by a commonly known method using a mixer.

Of the toner particle preparation methods, the pulverizing method is particularly preferable since the method involves less steps and requires less capital-investment spending than wet processes. Hereinafter, how to prepare toner particles by the pulverizing method will be described.

In the preparation of the toner by the pulverizing method, toner materials including at least a binding resin and a colorant, and optionally including a charge controlling agent and a release agent are mixed, melted and kneaded to give a kneaded product. Subsequently, the kneaded product is cooled, solidified and pulverized, and then subjected to particle size control such as classification as needed to give toner particles.

Dry mixing is preferable, and a commonly known apparatus that is conventionally used in the art may be used as the mixer. Examples of the mixer include mixing apparatuses of a Henschel type such as Henschel mixer (trade name, product by Mitsui Mining Co., Ltd.), Super Mixer (trade name, product by KAWATA MFG Co., Ltd.) and Mechanomill (trade name, product by OKADA SEIKO CO., LTD.); and other mixing apparatuses such as Angmill (trade name, product by Hosokawa Micron Corporation), Hybridization System (trade name, product by Nara Machinery Co., Ltd.) and Cosmosystem (trade name, product by Kawasaki Heavy Industries, Ltd.)

As the kneading machine, a commonly known apparatus that is conventionally used in the art may be used, and examples thereof include common kneading machines such as a twin-screw extruder, a three-roll mill and a laboblast mill. For example, may be mentioned single-screw or twin-screw extruders such as TEM-100B (model number, product by Toshiba Machine Co., Ltd.), and PCM-65/87 and PCM-30 (model numbers, products by Ikegai Corporation); and open roll kneading machines such as Kneadex (trade name, product by Mitsui Mining Co., Ltd.), of which the open roll kneading machines are preferable in that they exhibit high shear force during kneading and are capable of highly dispersing the release agent and the colorant (coloring material) such as a pigment.

As the pulverizer, a commonly known apparatus that is conventionally used in the art may be used, and examples thereof include a jet type pulverizer that performs pulverization using a supersonic jet stream and an impact type pulverizer that introduces the solidified product in space formed between a rotator (a rotor) that rotates at high speed and a stator (liner) to perform pulverization.

For the classification, a commonly known classifier that is conventionally used in the art such as, in particular, a rotating type pneumatic classifier (rotary pneumatic classifier) may be used which can remove overpulverized base toner particles using centrifugal force and wind force.

The resulting toner particles preferably have a volumetric average particle diameter of 3 to 10 μm, and more preferably 5 to 8 μm.

When the volumetric average particle diameter of the toner particles is within the above-specified range, it is possible to steadily form high-definition images over a long period of time. When the volumetric average particle diameter of the toner particles is less than 3 μm, the particle diameter of the toner particles is so small that the toner is highly charged and reduced in flowability. As a result, it is impossible to steadily supply the toner to a photoreceptor, and background fogging and image density reduction may occur. When the volumetric average particle diameter of the toner particles is more than 10 μm, on the other hand, the particle diameter of the toner particles is so large that a high-definition image may not be obtained.

Specific examples of the volumetric average particle diameter of the toner particles include 3 μm, 4 μm, 5 μm, 6 μm, 7 μm, 8 μm, 9 μm and 10 μm.

(Physical Properties of Toner)

The toner of the present invention has a volume resistivity of $40\times10^9$ to $220\times10^9$ Ωcm and a negative polarity.

When the volume resistivity of the toner is within the above-specified range, it is possible to steadily form high-definition images over a long period of time. When the volume resistivity of the toner is less than $40\times10^9$ Ωcm, reduction in charging of the toner is significant under a high-humidity environment, and toner scattering may occur. When the volume resistivity of the toner is more than $220\times10^9$ Ωcm, on the other hand, rise in charging of the toner is significant under a low-humidity environment and the development property is impaired, and therefore it is necessary to adjust the concentration of the toner in the developer higher. Accordingly, pollution on the carrier surface with the toner spent or the external additive increases and the charge amount is significantly reduced, and toner scattering may occur.

Preferably, the toner has a negative polarity. When the toner has a positive polarity, toner scattering and background fogging are likely to occur.

Specific examples of the volume resistivity of the toner include $40\times10^9$, $50\times10^9$, $75\times10^9$, $100\times10^9$, $125\times10^9$, $150\times10^9$, $200\times10^9$ and $220\times10^9$ Ωcm.

In the present invention, preferably, the organic pigment as the colorant is a magenta pigment or a yellow pigment, and the polyester resin has a volume resistivity of $250\times10^9$ to $400\times10^9$ Ωcm.

When the organic pigment as the colorant is a magenta pigment or a yellow pigment, but the polyester resin has a volume resistivity of more than $400\times10^9$ Ωcm, another material having a significant conductive effect needs to be added in order to adjust the volume resistivity of the toner to $220\times10^9$ Ωcm or lower. In the case of a color developer, one common approach is to add a colorless material having less influence on the color tone such as titania and alumina. In order for the material to exert its conductive effect, the material desirably exists on the toner surface. While it is common that the material is added externally, the externally added material may not exert the conductive effect since it may be buried in or separated from the base toner particles. When the polyester resin has a volume resistivity of less than $250\times10^9$ Ωcm, on the other hand, the toner has a too low volume resistivity to be sufficiently charged, and therefore toner scattering may easily occur. Accordingly, it is preferable that the polyester resin has a volume resistivity in the above-specified range.

Specific examples of the volume resistivity of the polyester resin include $250\times10^9$, $275\times10^9$, $300\times10^9$, $325\times10^9$, $350\times10^9$ and $400\times10^9$ Ωcm.

(2) Carrier

The resin-coated carrier of the present invention may be any carriers that are conventionally used in the art. Examples thereof include those obtained by surface coating a single or composite ferrite of iron, copper, zinc, nickel, cobalt, manganese, chromium, strontium and the like as carrier core particles (core particles) with a resin as a coating material.

(Core Particles)

For the core particles, commonly known magnetic particles can be used, and particles containing a ferrite component (ferrite-based particles) are preferable. The ferrite-based particles have high saturation magnetization and allow formation of a low-density coated carrier. Used in a developer, therefore, the coated carrier is unlikely to adhere to a photoreceptor, and a soft magnetic brush is formed, providing an image with high dot reproduction.

Commonly known ferrite-based particles may be used, and examples thereof include particles of zinc ferrite, nickel ferrite, copper ferrite, nickel-zinc ferrite, manganese-magnesium ferrite, copper-magnesium ferrite, manganese-zinc ferrite, manganese-copper-zinc ferrite and manganese-magnesium-strontium ferrite.

The ferrite-based particles can be prepared by a commonly known method. For example, ferrite materials such as $Fe_2O_3$ and $Mg(OH)_2$ are mixed, and the mixed powder is heated and pre-baked in a heating furnace. The resulting pre-baked product is cooled, and then pulverized with an oscillating mill to be particles having a size of approximately 1 μm. Then, a dispersant and water are added to the pulverized powder to give a slurry. The slurry is subjected to wet grinding with a wet ball mill, and the resulting suspension is subjected to dry granulation with a spray drier to give ferrite-based particles.

The core particles preferably have a volumetric average particle diameter of 20 to 60 μm, and more preferably 30 to 50 μm.

Specific examples of the volumetric average particle diameter of the core particles include 20 μm, 25 μm, 30 μm, 35 μm, 40 μm, 45 μm, 50 μm, 55 μm and 60 μm.

Preferably, the core particles have a volume resistivity of $1\times10^6$ to $1\times10^{11}$ Ωcm when measured by a bridge method. Ferrite-based particles having a volume resistivity in this range are commonly used as being inexpensive.

When the volume resistivity is too low, fogging may occur in a toner image due to poor electrical insulation properties. When the volume resistivity is too high, on the other hand, an edge effect and image density reduction are likely to occur in an outer part of a solid image due to a counter charge remaining on a carrier surface. More preferably, the volume resistivity is in the range from $1\times10^8$ to $5\times10^{10}$ Ωcm.

Specific examples of the volume resistivity of the core particles include $1\times10^6$, $1\times10^7$, $1\times10^8$, $1\times10^9$, $1\times10^{10}$ and $1\times10^{11}$ Ωcm.

(Coat Layer)

In the present invention, the thickness of the resin layer (coat layer) of the resin-coated carrier (coated carrier) is not particularly limited and is preferably 1 to 5 μm.

Specific examples of the thickness of the coat layer include 1 μm, 2 μm, 3 μm, 4 μm and 5 μm.

Any resin usable for the coat layer such as acrylic resin and silicone resin can be used as the resin for forming the coat layer of the present invention.

Examples of the acrylic resin include polyacrylate, polymethyl methacrylate, polyethyl methacrylate, poly-n-butyl methacrylate, polyglycidyl methacrylate, polyfluorine-containing acrylate, styrene-methacrylate copolymer, styrene-butylmethacrylate copolymer and styrene-ethyl acrylate copolymer.

Examples of commercially available products include model number: Dianal SE-5437 manufactured by Mitsubishi Rayon Co., Ltd.), model number: S-LEC PSE-0020 manufactured by Sekisui Chemical Co., Ltd., model number: HIMER ST95 manufactured by Sanyo Chemical Industries Ltd. and model number: FM601 manufactured by Mitsui Chemicals, Inc.

Examples of the silicone resin include silicone varnish (model number: KR-271, manufactured by Shin-Etsu Chemical Co., Ltd.; and model number: TSR115, manufactured by Toshiba silicone Co., Ltd. (present Momentive Performance Materials Inc)), alkyd modified silicone varnish (model number: TSR184, manufactured by Toshiba silicone Co., Ltd.), epoxy modified silicone varnish (model number: TSR194, manufactured by Toshiba silicone Co., Ltd.), polyester modified silicone varnish (model number: TSR187, manufactured by Toshiba silicone Co., Ltd.), acryl modified silicone varnish (model number: TSR170, manufactured by Toshiba silicone Co., Ltd.), urethane modified silicone varnish (model number: TSR175, manufactured by Toshiba silicone Co., Ltd.) and reactive silicone resin (model number: KA1008, manufactured by Shin-Etsu Chemical Co., Ltd.)

In particular, a coated carrier having a layer of straight silicone resin (alkyl substituted silicone resin) is preferable in that the surface thereof is less subject to adhesion (filming) of a component of the toner (binding resin), and therefore the toner charging ability can be maintained over a long period of time.

In addition, any curable resins that are conventionally used in the art can be used. Of the curable resins, curable silicone resin is silicone resin that is cured by cross-linking due to a thermal dehydration reaction or the like between hydroxyl groups or between a hydroxyl group and a group —OX that are attached to the Si atom, for example, as shown below.

[Scheme 1]

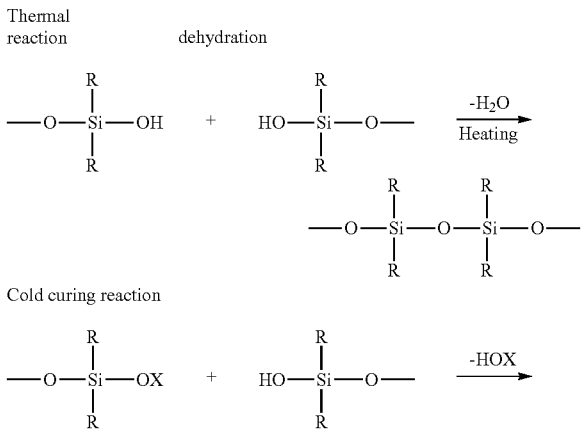

-continued

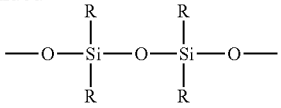

In the scheme, Rs, the same or different, each represent a monovalent organic group, and the group —OX represents an acetoxy group, an aminoxy group, an alkoxy group, an oxime group or the like.

Methods of cross-linking a thermosetting silicone resin include a method by heating the resin to approximately 200 to 250° C. and a method by heating the resin to approximately 100 to 200° C., which is lower than the former temperature, using a catalyst such as an organic acid or dibutyltin.

Of cross-linkable silicone resins, those in which the monovalent organic groups represented by Rs are methyl groups are preferable. Since the cross-linkable silicone resins in which Rs are methyl groups have a minute cross-linked structure, a coat layer formed of such a cross-linkable silicone resin provides a coated carrier having good water repellency and moisture vapor resistance.

When the cross-linked structure is too minute, however, the coat layer tends to be fragile, and therefore the molecular weight of the thermally cross-linkable silicone resin is importantly selected.

Examples of the thermosetting resin other than the thermosetting silicone resin include phenol resin, urea resin, melamine resin, unsaturated polyester resin, epoxy resin, diallyl phthalate resin, polyurethane resin and polyimide resin.

Preferably, the coverage of the hard particles for the surfaces of the core particles is 30% to 70%. When the coverage is less than 30%, the coat layer is likely to have nonuniform film thickness. When the coverage is more than 70%, the coat layer for coating the hard particles is likely to have a void, leading to reduced strength. The coverage can be adjusted by appropriately setting coating conditions such as the addition amount, the rotation frequency of an agitating blade and the jacket temperature, for example.

Specific examples of the coverage of the hard particles include 30%, 35%, 40%, 45%, 50%, 55%, 60%, 65% and 70%.

(Method for Producing Coated Carrier)

The method for producing the coated carrier of the present invention includes a resin layer forming step of forming a resin layer on the surfaces of the core particles.

As the method for forming a resin layer on the surfaces of the core particles, a commonly known method that is used to form a coat layer of a carrier being coated may be employed. Examples thereof include a dipping method in which a coating solution for resin layer formation is prepared by dissolving or dispersing a resin and, as needed, an additive in a solvent, and the core particles are immersed in the coating solution; a spraying method in which the coating solution for resin layer formation is sprayed onto the core particles; a fluid bed method in which the coating solution for resin layer formation is sprayed while the core particles are floated by flowing air; and a kneader and coater method in which the core particles and the coating solution for resin layer formation are mixed in a kneader and coater, and the solvent is removed. Of these methods, the dipping method is preferable in that film formation is easy.

The solvent of the coating solution for resin layer formation is not particularly limited as long as it can dissolve the resin being used, and examples thereof include organic solvents including aromatic hydrocarbons such as toluene and xylene; ketones such as acetone and methyl ethyl ketone; ethers such as tetrahydrofuran and dioxane; and higher alcohols. The solvents may be used independently, or two or more kinds may be used as a mixed solvent.

The amount of the resin in the coating solution for resin layer formation may be determined as appropriate in view of the coating practicability and is in the range from 5 to 50 parts by weight, for example, and preferably in the range from 10 to 30 parts by weight with respect to 100 parts by weight of the coating solution. When the amount of the resin is too small, it takes a long time to form the resin layer on the surfaces of the core particles. When the amount of the resin is too large, on the other hand, the dispersibility of the resin is poor.

The process for curing the resin layer may be determined as appropriate according to the kinds of the resin and the solvent. In the case of a thermosetting resin, the resin is heated at approximately 200 to 250° C., for example, or heated at a lower temperature (for example, approximately 100 to 200° C.) using a curing catalyst, according to the kind of the resin. In the case of a cold-setting resin, heating is not necessarily needed, but the resin may be heated at approximately 150 to 280° C., for example, for the purpose of improving the mechanical strength of the resin layer being formed, shortening the curing period, and so on.

(Physical Properties of Coated Carrier)

The volumetric average particle diameter of the coated carrier is not particularly limited and is preferably 20 to 60 μm, and more preferably 30 to 50 μm.

When the volumetric average particle diameter is too small, the coated carrier is easily moved from a developing roller to a photoreceptor drum during development, and blank dots may be generated in an image obtained. When the volumetric average particle diameter is too large, on the other hand, dot reproducibility is poor, and an image obtained may be rough.

Specific examples of the volumetric average particle diameter of the coated carrier include 20 μm, 25 μm, 30 μm, 35 μm, 40 μm, 45 μm, 50 μm, 55 μm and 60 μm.

The volumetric average particle diameter of the carrier as used herein refers to a diameter of particles each including both the core particle and the coat layer, and the specific definition of the volumetric average particle diameter is the same as the definition of the volumetric average particle diameter of the toner particles and the core particles given above.

The smaller the saturation magnetization of the coated carrier is, the softer the magnetic brush to be in contact with the photoreceptor drum is, and the truer to an electrostatic latent image an image obtained is. When the saturation magnetization is too small, however, the coated carrier adheres to a surface of the photoreceptor drum, and blank dots are easily generated. When the saturation magnetization is too large, on the other hand, the magnetic brush becomes rigid, and it is difficult to obtain an image that is true to an electrostatic latent image. Accordingly, the saturation magnetization of the coated carrier is preferably in the range from 30 to 100 emu/g, and more preferably in the range from 50 to 80 emu/g.

Specific examples of the saturation magnetization of the coated carrier include 30, 40, 50, 60, 70, 80, 90 and 100 emu/g.

The volume resistivity of the coated carrier is not particularly limited and is preferably in the range from $3\times10^{9}$ to $5\times10^{12}$ Ωcm, and more preferably in the range from $2\times10^{10}$ to $5\times10^{11}$ Ωcm.

When the volume resistivity is lower than $3\times10^{9}$ Ωcm, the carrier adheres to the photoreceptor, and fogging is likely to occur in an image obtained. When the volume resistivity is higher than $5\times10^{12}$ Ωcm, on the other hand, the charge amount of the toner increases, and the image density is likely to be reduced.

The specific definition of the volume resistivity is the same as the definition of the volume resistivity of the core particles.

Specific examples of the volume resistivity of the coated carrier include $3\times10^{9}$, $1\times10^{10}$, $5\times10^{10}$, $1\times10^{11}$, $5\times10^{11}$, $1\times10^{12}$ and $5\times10^{12}$ Ωcm.

The coat durability of the coated carrier is 90% or more, and the upper limit thereof is approximately 95%.

When the coat durability of the carrier is less than 90%, the coat comes off as the developer lives its life and a polluted coat surface is freshened, during which the charging remains stable. In a later stage in the life, however, more area of the core surface of the carrier is exposed, and a phenomenon where the carrier itself is developed due to charge injection into the exposed core surface is likely to occur. Consequently, insufficient transfer easily occurs around the developed carrier, and it may cause an image defect as white spots. Furthermore, when the core surface is exposed too much, the carrier is easily polluted with toner spent, causing reduction in the charge amount.

Specific examples of the coat durability of the coated carrier include 90%, 91%, 92%, 93%, 94% and 95%.

(3) Two-Component Color Developer

The two-component color developer of the present invention is obtained by mixing (1) the toner and (2) the carrier by the above-described commonly known method using a mixer. Examples of the mixer include a V-shape mixer and a Nauta mixer.

In general, it is preferable that 3 to 15 parts by weight of the toner is mixed with 100 parts by weight of the carrier. It is more preferable that the range is from 4 to 10 parts by weight.

Specifically, 3, 4, 5, 6, 7, 8, 9, 10, 11, 12, 13, 14 or 15 parts by weight of the toner is mixed with 100 parts by weight of the carrier, for example.

The two-component color developer of the present invention, that is, a two-component color developer containing a toner and a resin-coated carrier, the toner containing at least a polyester resin as a binding resin, an organic pigment as a colorant and inorganic fine particles as an external additive, wherein the inorganic fine particles have a negative polarity, the toner has a volume resistivity of $40\times10^{9}$ to $220\times10^{9}$ Ωcm and a negative polarity, and the carrier has a coat durability of 90% or greater, is insusceptible to environmental variation and capable of providing stable images throughout its life.

In a two-component color developer that does not satisfy the above-described requirements, on the other hand, inorganic fine particles separated from base toner particles are accumulated on the carrier coat surface as the developer lives its life. Consequently, the chargeability is reduced, and toner scattering is likely to occur. In particular, when the toner has a high volume resistivity under a low-humidity environment, the toner is easily charged up, and the eclectic repulsion between the base toner particles and the inorganic fine particles increases. Consequently, the inorganic fine particles are easily separated from the base toner particles and thus facilitated to adhere to the carrier. When the toner has a too low volume resistivity, on the other hand, the toner itself is less chargeable, and therefore toner scattering is likely to occur.

(4) Image Forming Apparatus

An image forming apparatus of the present invention is characterized in that the two-component color developer of the present invention is used therein.

The image forming apparatus of the present invention will be described in detail with reference to FIG. 1, which is a schematic cross sectional view illustrating an example of the image forming apparatus.

A direction A in FIG. 1 is a direction from the front to the back of an image forming apparatus 100.

The image forming apparatus 100 is an electrophotographic printer. The image forming apparatus 100 is a so-called tandem printer, in which four visible image formation units (a yellow visible image formation unit 110Y, a magenta visible image formation unit 110M, a cyan visible image formation unit 110C and a black visible image formation unit 110B: these may be collectively referred to as "visible image formation units 110") are arranged along a recording paper conveyance path.

Specifically, the four visible image formation units 110 are disposed along the conveyance path of a recording paper P formed between a paper feed tray 120 for feeding the recording paper P (material being heated, recording medium) to the visible image formation units 110 and a fixing device 40. The visible image formation units 110 transfer and superimpose toner images of the respective colors on the recording paper P being conveyed by an endless conveyance belt 133 of recording paper conveying means 130, and subsequently the fixing device 40 fixes the toner images on the recording paper P. Thus, a full color image is formed.

The conveyance belt 133 is arranged so as to circulate around a driving roller 131 and an idling roller 132, and controlled to revolve at a predetermined circumferential speed (approximately 150 to 400 mm/second, for example, 220 mm/second). The recording paper P is conveyed while being held on the revolving conveyance belt 130 by electrostatic attraction.

The visible image formation units 110 each include a photoreceptor drum 111, and a charging roller 112, exposure means (laser irradiation means) 113, a developing device 114, a transfer roller 115 and a cleaner 116 disposed around the photoreceptor drum 111.

The developing device Y of the visible image formation unit 110Y contains a developer including a yellow toner, the developing device M of the visible image formation unit 110M contains a developer including a magenta toner, the developing device C of the visible image formation unit 110C contains a developer including a cyan toner, and the developing device B of the visible image formation unit 110B contains a developer including a black toner.

The developer may be a mono-component developer or a two-component developer.

The toner included in the mono-component developer may be any magnetic toner, and the carrier included in the two-component developer may be any magnetic carrier.

The toner images are transferred onto the recording paper P in the respective visible image formation units 110. The transfer is performed as follows. First, the charging roller 112 uniformly charges a surface of the photoreceptor drum 111, and then the surface of the photoreceptor drum 111 is exposed to laser light by the laser irradiation means 113 according to image information to form an electrostatic latent image. Thereafter, the toner is supplied to the electrostatic latent image on the surface of the photoreceptor drum 111 by the developing device 114. Thereby, the electrostatic latent image is developed (made visible) to give a toner image. The toner images formed on the surfaces of the respective photoreceptor drums 111 are transferred in sequence by the respective transfer roller 115, to which a bias voltage of a polarity reverse to the polarity of the toners of the toner images has been applied, onto the recording paper P being conveyed by the conveyance belt (conveying means) 130.

Thereafter, the recording paper P is separated from the conveyance belt 133 at a curved point of the conveyance belt 133 (a portion around the driving roller 131) and conveyed to the fixing device 40. In the fixing device 40, furthermore, a moderate temperature and pressure are given to the recording paper P by a fixing belt heated to a predetermined temperature. Thereby, the toners on the recording paper P are melted and fixed on the recording paper P, forming a robust image on the recording paper P.

EXAMPLES

Hereinafter, the present invention will be described in detail by way of examples and comparative examples; however, the present invention is not limited to these examples.

[Preparation of Toner]

(Toner 1)

The following toner materials were premixed for 3 minutes using a Henschel mixer (fluidized bed mixer, model number: FM20C, product by Mitsui Mining Co., Ltd. (present Nippon Coke & Engineering. Co., Ltd.)), and then melted and kneaded at a cylinder temperature set to 110° C., a barrel rotation frequency of 300 rpm and a material feeding rate of 20 kg/hour using a twin-screw extruder (model number: PCM-30, product by Ikegai Corporation) to give a melted and kneaded product.

The following binder resin and colorant were preliminarily melted and kneaded to prepare a masterbatch.

The resulting melted and kneaded product was cooled on a cooling belt, coarsely pulverized using a pulverizing (coarsely pulverizing) machine having a screen with a mesh size of 2 mm (model number: VM-16, product by THE ORIENT CO., LTD, finely pulverized using a jet pulverizer (model number: IDS-2, product by Nippon Pneumatic Mfg. Co., Ltd.), and then classified using an elbow jet classifier (model number: EJ-LABO, product by Nittetsu Mining Co., Ltd.) to give a toner 1.

Polyester resin A 42 parts by weight

Polyester resin B 42 parts by weight

| | |
|---|---|
| Magenta masterbatch (polyester resin B + Pigment Red 269, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 2)

A toner 2 was obtained in the same manner as in the toner 1 except that the following toner materials were used.

Polyester resin A 42 parts by weight

Polyester resin B 42 parts by weight

| | |
|---|---|
| Magenta masterbatch (binder resin B + Pigment Red 57:1, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 3)

A toner 3 was obtained in the same manner as in the toner 1 except that the following toner materials were used.

Polyester resin A 42 parts by weight

Polyester resin B 42 parts by weight

| | |
|---|---|
| Yellow masterbatch (binder resin B + Pigment Yellow 74, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 4)

A toner 4 was obtained in the same manner as in the toner 1 except that the following toner materials were used.

Polyester resin A 42 parts by weight

Polyester resin B 42 parts by weight

| | |
|---|---|
| Yellow masterbatch (binder resin B + Pigment Yellow 185, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 5)

A toner 5 was obtained in the same manner as in the toner 1 except that the following toner materials were used.

Polyester resin A 42 parts by weight

Polyester resin B 42 parts by weight

| | |
|---|---|
| Cyan masterbatch (binder resin B + Pigment Blue 15:3, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 6)

A toner 6 was obtained in the same manner as in the toner 1 except that the following toner materials were used.

Polyester resin C 42 parts by weight

Polyester resin D 42 parts by weight

| | |
|---|---|
| Magenta masterbatch (polyester resin D + Pigment Red 269, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 7)

A toner 7 was obtained in the same manner as in the toner 1 except that the following toner materials were used.

Polyester resin C 42 parts by weight

Polyester resin D 42 parts by weight

| | |
|---|---|
| Magenta masterbatch (binder resin D + Pigment Red 57:1, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 8)

A toner 8 was obtained in the same manner as in the toner 1 except that the following toner materials were used.

Polyester resin C 42 parts by weight
Polyester resin D 42 parts by weight

| | |
|---|---|
| Yellow masterbatch (binder resin D + Pigment Yellow 74, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 9)

A toner 9 was obtained in the same manner as in the toner 1 except that the following toner materials were used.

Polyester resin C 42 parts by weight
Polyester resin D 42 parts by weight

| | |
|---|---|
| Yellow masterbatch (binder resin D + Pigment Yellow 185, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 10)

A toner 10 was obtained in the same manner as in the toner 1 except that the following toner materials were used.

Polyester resin C 42 parts by weight
Polyester resin D 42 parts by weight

| | |
|---|---|
| Cyan masterbatch (binder resin D + Pigment Blue 15:3, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

(Toner 11)

A toner 11 was obtained in the same manner as in the toner 1 except that the following toner materials were used.

Polyester resin E 84 parts by weight

| | |
|---|---|
| Cyan masterbatch (binder resin D + Pigment Blue 15:3, weight ratio = 60:40) | 9 parts by weight |
| Charge controlling agent (model number: LR147, product by Japan Carlit Co., Ltd.) | 1 part by weight |
| Paraffin wax (model number: HNP-11, product by Nippon Seiro Co., Ltd.) | 6 parts by weight |

[Preparation of Negatively Charged Toner]

To 100 parts by weight of each toner obtained, 0.8 parts by weight of silica particles A (volumetric average particle diameter: 110 nm, surface-treated with hexamethyldisilazane (HMDS)), 1.5 parts by weight of silica particles B (volumetric average particle diameter: 12 nm, surface-treated with hexamethyldisilazane (HMDS)) and 0.5 parts by weight of titanium oxide particles (volumetric average particle diameter: 40 nm) were added, and the mixture was mixed under agitation at a agitating blade tip speed of 35 m/second for 4 minutes using a Henschel mixer (fluidized bed mixer, model number: FM20C, product by Mitsui Mining Co., Ltd. (present Nippon Coke & Engineering. Co., Ltd.)) to give negatively charged toners 1 to 11.

[Measurement of Volume Resistivity of Resin and Toner]

The volume resistivity of the resins A to E used for the preparation of the toners and the resultant negatively charged toners 1 to 11 was measured.

The volume resistivity of the resins and the toners was measured using a dielectric loss measuring apparatus (model number: TR-10C, product by Ando Electric Co., Ltd. (present Yokogawa Electric Corporation)) at a frequency of 1 kHz under a normal-temperature and normal-humidify (25° C. and 50%) environment. For measurement samples, each resin or toner prepared was milled and molded so as to have an outer diameter of 25 mm and a thickness of approximately 2 mm using a tablet machine (model number: TB-50H, product by NPa System Co., Ltd.)

Tables 1 and 2 show the results obtained. Table 1 also shows physical properties of the polyester resins as the resins A to E.

TABLE 1

| | Weight average molecular weight Mw | Number average molecular weight Mn | Glass transition temperature Tg (° C.) | ½ softening temperature Tm (° C.) | Volume resistivity $\times 10^9$ Ωcm |
|---|---|---|---|---|---|
| Resin A | 100,000 | 6,000 | 66 | 130 | 258 |
| Resin B | 25,000 | 5,000 | 64 | 110 | 388 |
| Resin C | 100,000 | 7,000 | 70 | 140 | 450 |
| Resin D | 15,000 | 4,000 | 60 | 100 | 561 |
| Resin E | 70,000 | 3,500 | 65 | 125 | 210 |

TABLE 2

| | Volume resistivity $\times 10^9$ Ωcm |
|---|---|
| Toner 1 | 220 |
| Toner 2 | 216 |
| Toner 3 | 205 |
| Toner 4 | 204 |
| Toner 5 | 40 |
| Toner 6 | 300 |
| Toner 7 | 288 |
| Toner 8 | 301 |
| Toner 9 | 303 |
| Toner 10 | 55 |
| Toner 11 | 28 |

[Preparation of Coated Carrier]

As ferrite materials, 50 mol % of iron oxide, 35 mol % of manganese oxide, 14.5 mol % of magnesium oxide and 0.5 mol % of strontium oxide (all of which are manufactured by KDK) were pulverized with a ball mill for 4 hours, the resultant slurry was dried with a spray dryer, and the resultant particles having a true sphere shape were pre-baked with a rotary kiln at 930° C. for 2 hours. The resultant pre-baked powder was finely pulverized so as to have an average particle diameter of 2 μm or less with a wet pulverizer (pulverizing medium: steel balls).

To the slurry, 2% by weight of PVA was added, and granulated and dried with a spray dryer, and baked in an electric furnace at a temperature of 1100° C. and an oxygen concentration of 0% by volume for 4 hours. Thereafter, cracking and classification were performed, thereby giving ferrite core particles having a volumetric average particle diameter of 38 μm and a volume resistivity $2\times10^9$ Ωcm as measured by a bridge method.

The following materials were dissolved or dispersed in toluene (320 parts by weight) to give a second coating solution for resin layer formation.

| | |
|---|---|
| Thermosetting silicone resin: silicone resin (trade name: SR2411, product by Dow Corning Toray Co., Ltd.) | 80 parts by weight |
| Conductive agent: conductive carbon black (trade name: VULCANXC72, product by Cabot Corporation) | 5 parts by weight |
| Charge controlling agent: negative charge controlling agent (trade name: LR-147, product by Japan Carlit Co., Ltd.) | 20 parts by weight |
| Coupling agent: silane coupling agent (trade name: SH6020, product by Dow Corning Toray Co., Ltd.) | 1 part by weight |

Specifically, the conductive agent (conductive particles) was dispersed in a toluene solvent using a dispersant to preliminarily give a dispersion, and a solution of the charge controlling agent and a solution of the coupling agent were prepared. Thereafter, the dispersion and the solutions were mixed with and dispersed in toluene in which the silicone resin had been dissolved, and further agitated with a three one motor for 5 minutes to give a coating solution.

The above-described core particles subjected to the hard particle coating step (1000 parts by weight) and the above-described coating solution for resin layer formation (426 parts by weight) were put in an agitator provided with a heating jacket and an agitating blade, and mixed by rotating the agitating blade at a speed of 30 revolutions per minute. Toluene was removed under heating at a reduced pressure, thereby forming a resin layer.

The resin layer was cured by heating at 250° C. for 2 hours, 1.5 hours and 1 hour, separately, and then the particles were sieved through a 100 mesh screen to give coated carriers 1 to 3.

The resultant carriers had a volumetric average particle diameter of 40 μm, a coverage of 100%, a volume resistivity of $2\times10^{11}$ Ωcm and a saturation magnetization of 68 emu/g.

[Carrier Coat durability]

A prescribed amount (200 g) of each developer was put in a development unit of a commercially available full color copying machine (model number: MX-3610FN, product by Sharp Corporation) modified for the evaluation and subjected to idle rotation with a rotation testing machine at a magnet roller rotation frequency of 300 rpm for 24 hours. During the idle rotation, a magnet roller was blocked with paper or the like in order to prevent toner scattering.

In the case of a silicone-based coating material, the strength of Si and Fe in the carrier obtained by separating the toner from the developer was measured using a scanning fluorescent X-ray analyzer (model number: ZSX Primus, product by Rigaku Corporation). The coat durability (residual ratio) was calculated from Si/Fe ratios before and after the idle rotation.

In the case of an acryl-based coating material, a peak area derived from the coating material was measured using a gas chromatograph mass spectroscope (model number: Agilent 7890GC/5975MSD, product by Agilent Technologies Inc.) at a heating temperature set to 500° C. The coat durability (residual ratio) was calculated from the ratio between the peak areas before and after the idle rotation.

Table 3 shows the results obtained.

TABLE 3

| | Coat durability % |
|---|---|
| Carrier 1 | 94 |
| Carrier 2 | 90 |
| Carrier 3 | 88 |

[Preparation of Two-Component developer]

According to the combinations of the negatively charged toners 1 to 11 with the coated carriers 1 to 3 shown in Table 4, 7 parts by weight of each negatively charged toner and 93 parts by weight of each coated carrier were mixed under agitation for 20 minutes with a V type mixer (model number: V-5, product by TOKUJU Co., Ltd.), thereby giving two-component developers of Examples 1 to 11 and Comparative Examples 1 to 11.

[Evaluation of Toner Scattering and White Spots]

Using a commercially available full color copying machine (model number: MX-3610FN, product by Sharp Corporation) modified for the evaluation, printing with the respective colors (cyan: C, magenta: M, yellow: Y) was performed on 70,000 sheets of paper at a coverage of 15% under a normal-temperature and low-humidity (25° C., 5%: NIL) environment and under a normal-temperature and high-humidity (25° C., 85%: N/H) environment, and toner scattering and white spots were evaluated according to the following criteria.

(Toner Scattering)

Good: The toner was not scattered from the development unit, not staining the photoreceptor process unit or the inside of the copying machine, and not causing a defective image.

Bad: The toner was scattered from the development unit, staining the photoreceptor process unit or the inside of the copying machine, and causing a defective image.

Specific examples of the "bad" case include the following:

The toner scattered stained a main charger portion, and abnormal electrical discharge occurred in the stained area. As a result, the carrier was developed on the photoreceptor, and the developer was reduced.

The toner scattered stained an image adjustment sensor portion in the copying machine, causing a malfunction. As a result, an appropriate image was not obtained.

The toner scattered adhered to a non-latent image area, transferred and fixed on a paper sheet, causing an defective image.

(White Spots)

Good: No white spot was observed in a solid image or a halftone image on the whole area of an A3 sheet.

Bad: One or more white spots were observed in a solid image or a halftone image on the whole area of an A3 sheet.

Table 4 shows the results obtained.

TABLE 4

| | Two-component developer | | Evaluation | | |
|---|---|---|---|---|---|
| | | | Toner scattering | | |
| | Negatively charged toner | Coated carrier | N/L environment | N/H environment | White spots |
| Example 1 | Toner 1 | Carrier 1 | Good | Good | Good |
| Example 2 | Toner 2 | Carrier 1 | Good | Good | Good |
| Example 3 | Toner 3 | Carrier 1 | Good | Good | Good |
| Example 4 | Toner 4 | Carrier 1 | Good | Good | Good |
| Example 5 | Toner 5 | Carrier 1 | Good | Good | Good |
| Example 6 | Toner 1 | Carrier 2 | Good | Good | Good |
| Example 7 | Toner 2 | Carrier 2 | Good | Good | Good |
| Example 8 | Toner 3 | Carrier 2 | Good | Good | Good |
| Example 9 | Toner 4 | Carrier 2 | Good | Good | Good |
| Example 10 | Toner 5 | Carrier 2 | Good | Good | Good |
| Example 11 | Toner 10 | Carrier 2 | Good | Good | Good |
| Comparative Example 1 | Toner 6 | Carrier 2 | Bad | Good | Good |
| Comparative Example 2 | Toner 7 | Carrier 2 | Bad | Good | Good |

TABLE 4-continued

| | Two-component developer | | Evaluation | | |
|---|---|---|---|---|---|
| | | | Toner scattering | | |
| | Negatively charged toner | Coated carrier | N/L environ-ment | N/H environ-ment | White spots |
| Comparative Example 3 | Toner 8 | Carrier 2 | Bad | Good | Good |
| Comparative Example 4 | Toner 9 | Carrier 2 | Bad | Good | Good |
| Comparative Example 5 | Toner 1 | Carrier 3 | Good | Good | Bad |
| Comparative Example 6 | Toner 2 | Carrier 3 | Good | Good | Bad |
| Comparative Example 7 | Toner 3 | Carrier 3 | Good | Good | Bad |
| Comparative Example 8 | Toner 4 | Carrier 3 | Good | Good | Bad |
| Comparative Example 9 | Toner 5 | Carrier 3 | Good | Good | Bad |
| Comparative Example 10 | Toner 10 | Carrier 3 | Good | Good | Bad |
| Comparative Example 11 | Toner 11 | Carrier 2 | Good | Bad | Good |

Table 4 indicates that the two-component color developers of the present invention (Examples 1 to 11) are stable against environmental variation and capable of preventing toner scattering and generation of white spots. On the other hand, it is indicated that the two-component color developers of Comparative Examples 1 to 11 are faulty, causing any of toner scattering and white spots under the normal-temperature and low-humidity environment and a normal-temperature and high-humidity environment.

DESCRIPTION OF THE REFERENCE NUMERALS

40 Fixing device,
P Recording paper (recording material)
100 Image forming apparatus
110Y Yellow visible image formation unit
110M Magenta visible image formation unit
110C Cyan visible image formation unit
110B Black visible image formation unit
111 Photoreceptor drum
112 Charging roller
113 Exposure means (laser irradiation means)
114 Developing device
115 Transfer roller
116 Cleaner
120 Paper feed tray
130 Recording paper conveying means
131 Driving roller
132 Idling roller
133 Endless conveyance belt
A Direction of page of drawing
Y Developing device containing developer including yellow toner
C Developing device containing developer including cyan toner
M Developing device containing developer including magenta toner
B Developing device containing developer including black toner

The invention claimed is:

1. A two-component color developer containing a toner and a resin-coated carrier, the toner containing at least a polyester resin as a binding resin, an organic pigment as a colorant, and inorganic fine particles as an external additive, wherein the inorganic fine particles have a negative polarity, the toner has a volume resistivity of $40\times10^9$ to $220\times10^9$ Ωcm and a negative polarity, and the carrier has a coat durability of 90% or greater, wherein the coat durability is a value obtained by two different ways to be described below after a prescribed amount of 200 g of the developer is put in a development unit of a full color copying machine, and a magnet roller is blocked and is subjected to idle rotation with a rotation testing machine at a magnet roller rotation frequency of 300 rpm for 24 hours:

in the case where the resin-coated carrier has a resin layer made of a silicone-based coating material, the value is obtained by measuring strength of Si and Fe in the carrier obtained by separating the toner from the developer with use of a scanning fluorescent X-ray analyzer and by calculating Si/Fe ratios before and after the idle rotation; or in the case where the resin-coated carrier has a resin layer made of an acryl-based coating material, the value is obtained by measuring a peak area derived from the coating material with use of a gas chromatograph mass spectroscope at a heating temperature set to 500° C. and by calculating a ratio between peak areas before and after the idle rotation.

2. The two-component color developer according to claim 1, wherein the organic pigment is a magenta pigment or a yellow pigment, and the polyester resin has a volume resistivity of $250\times10^9$ to $400\times10^9$ Ωcm.

3. The two-component color developer according to claim 1, the binding resin has a weight average molecular weight in the range from 9,000 to 90,000, and molecular weights of 100,000 or more account for 10 to 30% in the molecular weight distribution of the binding resin.

4. An image forming apparatus in which the two-component color developer of claim 1 is used.

* * * * *